US010420707B2

(12) United States Patent
Lewis

(10) Patent No.: US 10,420,707 B2
(45) Date of Patent: Sep. 24, 2019

(54) PORTABLE AUTOMATED MEDICATION DISPENSER

(71) Applicant: Victor Lewis, Latham, NY (US)

(72) Inventor: Victor Lewis, Latham, NY (US)

( * ) Notice: Subject to any disclaimer, the term of this patent is extended or adjusted under 35 U.S.C. 154(b) by 117 days.

(21) Appl. No.: 15/593,038

(22) Filed: May 11, 2017

(65) Prior Publication Data

US 2017/0326034 A1 Nov. 16, 2017

Related U.S. Application Data

(60) Provisional application No. 62/334,859, filed on May 11, 2016, provisional application No. 62/426,687, filed on Nov. 28, 2016.

(51) Int. Cl.

*A61J 7/00* (2006.01)
*A61J 7/04* (2006.01)
*A61J 1/18* (2006.01)

(52) U.S. Cl.

CPC ..... *A61J 7/0084* (2013.01); *A61J 1/18* (2013.01); *A61J 7/0418* (2015.05); *A61J 7/0481* (2013.01); *A61J 2200/30* (2013.01)

(58) Field of Classification Search

CPC ..... A61J 7/0084; A61J 7/0481; A61J 7/0454; A61J 7/0418; A61J 7/0445; A61J 1/18; A61J 2200/30

See application file for complete search history.

(56) References Cited

U.S. PATENT DOCUMENTS

2013/0030566 A1* 1/2013 Shavelsky ..... A61J 7/04 700/244
2013/0197693 A1* 8/2013 Kamen ..... G06F 19/3418 700/244
2014/0172161 A1* 6/2014 Norris ..... G07F 11/005 700/237
2014/0278508 A1* 9/2014 Akdogan ..... A61J 7/0076 705/2
2014/0297028 A1* 10/2014 Bilotti ..... G06F 19/3462 700/237
2015/0227127 A1* 8/2015 Miller ..... G05B 19/042 700/244

* cited by examiner

*Primary Examiner* — Michael Collins

(57) ABSTRACT

Disclosed is a portable medication dispenser. The portable medication dispenser includes a housing comprising multiple compartments, wherein each compartment is configured to accommodate one or more medications, wherein the housing is constructed with a tamper-proof material. Further, the portable medication dispenser includes multiple latches corresponding to the multiple compartments. Yet further, the portable medication dispenser includes one or more actuators configured to engage with one or more latches of the multiple latches. Yet further, the portable medication dispenser includes a controller electrically coupled to the one or more actuators. Moreover, the portable medication dispenser includes a communication interface coupled to the controller, wherein the communication interface is configured to receive one or more commands associated with activating the one or more actuators. Additionally, the portable medication dispenser comprising a chemical agent to be released into at least one compartment upon command to render medication within the compartment inert.

29 Claims, 10 Drawing Sheets

PORTABLE AUTOMATED MEDICATION DISPENSER

FIELD OF THE INVENTION

The present disclosure generally relates to medication dispensers and more particularly to portable automated medication dispensers.

BACKGROUND OF THE INVENTION

A medication error is defined as any preventable event that may cause or lead to inappropriate medication use or harm to a patient. Since 2000, the Food and Drug Administration (FDA) has received more than 95,000 reports of medication errors. FDA reviews reports that come to MedWatch, the agency's adverse event reporting program. Actual numbers are expected to be higher, as many incidents go unreported. According to some studies, 400,000 preventable drug-related errors occur in hospitals each year; 800,000 occur in long-term care settings; and 530,000 occur in outpatient Medicare clinics Further, for many patients, the medications need to be tightly controlled. For example, if the medications include restricted or controlled medicines.

Moreover, there are many incidents of suicide by prescription drug overdose, medication theft, accidental misuse of medications, and the un-authorized use of someone else's medication. Of particular concern are increasing incidents of theft and diversion by hospital staff and pharmacies.

Therefore, automatic medication dispensers are used to dispense medicines. However, the available dispensers only partially solve the problems. The available dispensers are not fully secure and tamper proof; therefore, they are susceptible to forceful tampering with standard hand tools and light power tools. Further, some available dispensers are not able to accurately track, monitor and remind the patients to medicate properly.

Therefore, there is a need for improved medication dispensers.

SUMMARY

Disclosed is a portable medication dispenser. The portable medication dispenser includes a housing comprising multiple compartments, wherein each compartment is configured to accommodate one or more medications, wherein the housing is constructed with a tamper-proof material. Further, the portable medication dispenser includes multiple latches corresponding to the multiple compartments, wherein a latch corresponding to a compartment is configured to be in one of a locked state and an unlocked state, wherein, in the locked state, the latch is configured to prevent access to an interior space of the compartment, wherein, in the unlocked state, the latch is configured to allow access to the interior space facilitating dispensing of the one or more medications. Further, the portable medication dispenser includes one or more actuators configured to engage with one or more latches of the multiple latches, wherein, when activated, the one or more actuators engaged with a latch is configured to change the state of the latch from the locked state to the unlocked state. Yet further, the portable medication dispenser includes one or more power sources configured to supply power to drive the one or more actuators. Moreover, the portable medication dispenser includes a controller electrically coupled to the one or more actuators, wherein the controller is configured to activate the one or more actuators.

Yet further, the portable medication dispenser includes a communication interface coupled to the controller, wherein the communication interface is configured to receive one or more commands associated with activating the one or more actuators.

According to some aspects, a secure and tamper-proof portable automated prescription medication dispenser is disclosed. Further, the medication dispenser performs various tasks including tracking, monitoring and reminding patients to medicate properly. Moreover, it offers portability and prevents medication theft, abuse, and deliberate overdosing among patients, especially mental health and other outpatient populations.

According to some aspects, the disclosed medication dispenser is primarily made of stainless steel or a high strength acrylic laminate or a composite or a metal alloy. It is designed to withstand forceful tampering. The complete unit consists of two components that are securely locked together by the provider of the medications.

DETAILED DESCRIPTION OF THE INVENTION

Figure 1:
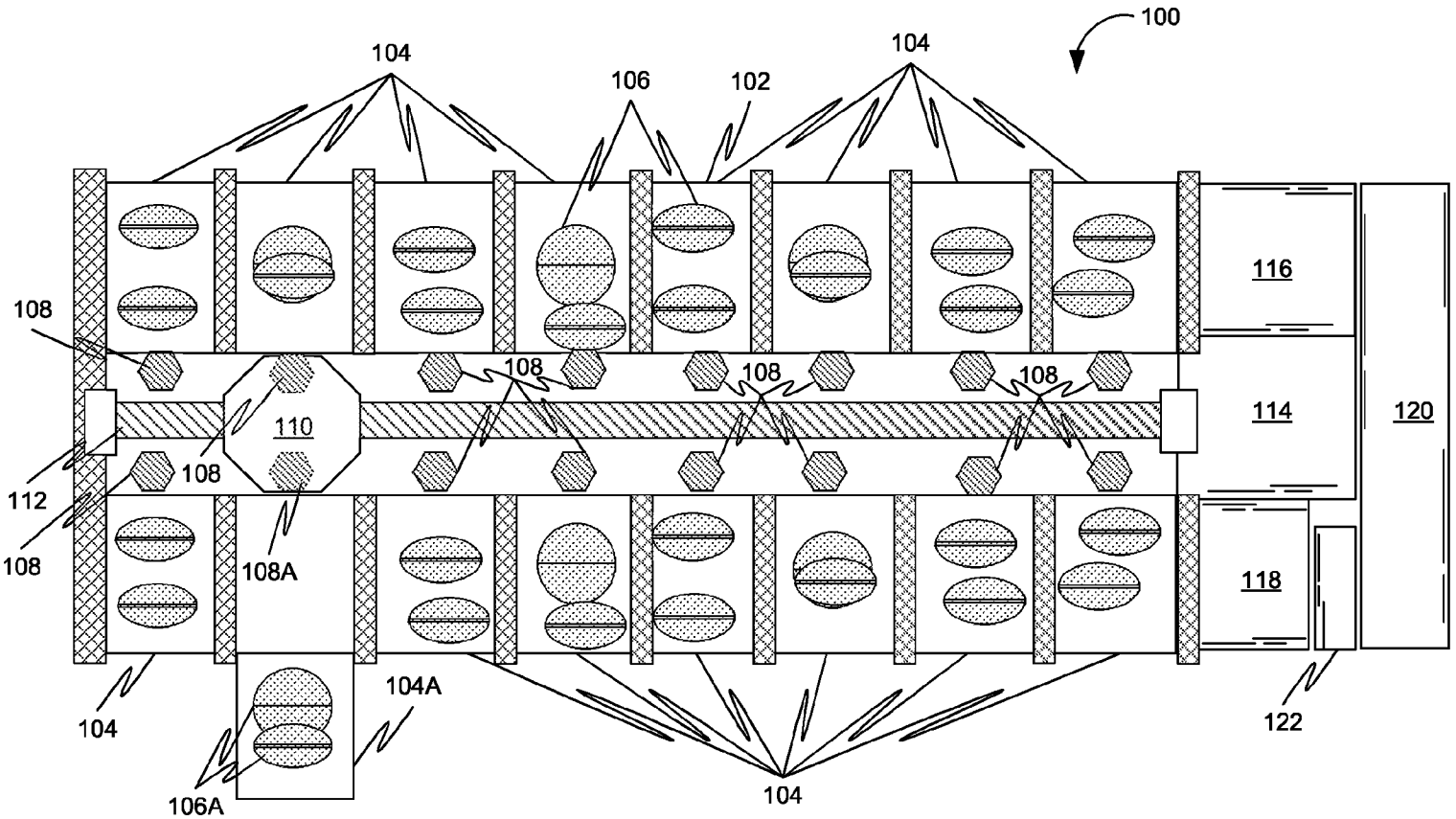
FIG. 1 illustrates a side view cross-section of a portable medication dispenser in accordance with some embodiments.

All descriptions are for the purpose of showing selected versions of the present invention and are not intended to limit the scope of the present invention.

Non-limiting and non-exhaustive embodiments of the present invention are described with reference to the preceding figures, wherein like reference numerals refer to like parts throughout the various views unless otherwise precisely specified.

FIG. 1 illustrates a side-view cross-section of a portable medication dispenser 100 in accordance with some embodiments. The portable medication dispenser 100 includes a housing 102 comprising multiple compartments 104. For example, the portable medication dispenser 100 may include two rows containing eight compartments each. Each compartment is configured to accommodate one or more medications 106. The housing 102 is constructed with a tamper-proof material, such as, but not limited to, stainless steel, a metal alloy, a high strength acrylic laminate and a composite plastic. Further, the housing may have a rectangular shape. Alternatively, the housing may be shaped as a disc, wherein the multiple compartments 104 are arranged around the disc. Further, an exposed surface of the multiple compartments 104 may be configured to be convex in shape in order to thwart tampering. Moreover, an exposed surface of the multiple compartments 104 may be coated with an abrasive or a vitreous material configured to abrade or deflect a drill-bit.

The portable medication dispenser 100 further includes multiple latches 108 corresponding to the multiple compartments 104. A latch in the multiple latches 108 corresponding to a compartment in the multiple compartments 104 is configured to be in one of a locked state and an unlocked state. In the locked state, the latch is configured to prevent access to an interior space of the corresponding compartment. In the unlocked state, the latch is configured to allow access to the interior space facilitating dispensing of the one or more medications. As shown in FIG. 1, a latch 108A is in an unlocked state, accordingly the corresponding compartment 104A is able to move out of the housing 102 and provide access to the interior space facilitating dispensing of the one or more medications 106A.

Further, the portable medication dispenser 100 includes one or more actuators 110 configured to engage with one or more latches in the multiple latches 108. The one or more actuators 110 engaged with a latch in the multiple latches 108 are configured to change the state of the latch from the locked state to the unlocked state. The one or more actuators 110 may further include a motor driven slide 112, a solenoid (not shown) and a stepper motor 114. The solenoid may be slidably mounted on the motor driven slide 112, wherein activating the one or more actuators 110 includes driving the motor driven slide 112 to displace the solenoid to a position on the motor driven slide 112 corresponding to the compartment (for example, the compartment 104A). According to further embodiments, the one or more actuators 110 may include multiple solenoids corresponding to the multiple compartments 104.

According to some embodiments, a latch in the multiple latches 108 may include a sliding door and an internal spring-loaded pin. For example, the sliding door may be made of metal. The sliding door may be configured to be in the locked state by the internal spring-loaded pin set in a loaded state, wherein an actuator in the one or more actuators 110 comprises a solenoid configured to pull back the internal spring-loaded pin into an unloaded state, causing the latch to change from the locked state to the unlocked state, wherein, in the unlocked state, the sliding door creates an opening into the interior space of the compartment.

In an alternate embodiment, the one or more actuators 110 may include a micro-hydraulic piston comprising an electrically controlled micro valve configured for directing a fluid. Further, the one or more actuators 110 may include a pneumatic piston comprising an electrically controlled micro valve configured for directing a pressurized gas.

The multiple latches 108 and the one or more actuators 110 are explained in further detail in conjunction with FIGS. 2A-C and FIG. 3 below.

Further, the portable medication dispenser 100 includes a battery 116 configured to supply power to drive the one or more actuators 110. Yet further, the portable medication dispenser 100 includes a controller 118 electrically coupled to the one or more actuators 110. The controller 118 is configured to activate the one or more actuators 110.

Further, the portable medication dispenser 100 includes a communication interface 120 coupled to the controller 118. The communication interface 120 is configured to receive one or more commands associated with activating the one or more actuators 110. The communication interface 120 may be further configured to wirelessly receive the one or more commands. A USB port 122 in the portable medication dispenser 100 may be used to connect the portable medication dispenser 100 with external devices.

The portable medication dispenser 100 may also include a memory (not shown) communicatively coupled to the controller 118, wherein the memory is configured to store the one or more commands. Accordingly, the communication interface 120 may be further configured to transmit data associated with activating the one or more actuators 110, wherein the data is stored in the memory. The communication interface 120 may be further configured to transmit data associated with one or more states of the one or more actuators 110, wherein the data is stored in the memory. Further, the portable medication dispenser 100 includes one or more sensors (not shown) configured to detect the one or more states. The portable medication dispenser 100 may further include one or more light indicators (not shown) configured to indicate the one or more states. For example, a light indicator in the one or more light indicators may be used to indicate the compartment whose latch is unlocked by one or more actuators 110.

Further, the memory may be configured to store one or more dispensing schedules (as per prescribed medication regimen). Accordingly, the controller 118 may be further configured to activate the one or more actuators 110 based on the one or more dispensing schedules. For example, a dispensing schedule may include providing access to a medicine every morning.

Yet further, the portable medication dispenser 100 may include a vibrator (not shown) configured to generate one or more of an audible sound and a vibration. The vibrator is communicatively coupled to the controller 118 and the battery 116, wherein the controller 118 is further configured to activate the vibrator based on the one or more dispensing schedules. For example, the vibrator may generate an audible sound when a patient needs to take medication as per a dispensing schedule.

Moreover, the portable medication dispenser 100 may include a tampering sensor (not shown) configured to detect tampering performed on the portable medication dispenser 100. The tampering sensor may be configured to detect breaking of the one or more compartments in the multiple compartments 104. The tampering sensor may be communicatively coupled to the communication interface 120, wherein the communication interface 120 may be further configured to transmit a tampering alert based on detection of tampering. The tampering alert may be sent to guardians of a patient, health care providers and even police.

Further, the portable medication dispenser 100 may include a one or more chemical containers including a chemical agent and one or more chemical actuators configured to release the chemical agent into one or more compartments of the multiple compartments 104 when the chemical actuator is activated. The one or more chemical actuators may be communicatively coupled to the tampering sensor, wherein detection of the tampering causes activation of the one or more chemical actuators. When the chemical agent comes in contact with one or more medications contained in the one or more compartments, the chemical agent reacts with the one or more medications in order to render the one or more medications unusable.

Further, the one or more chemical actuators may be communicatively coupled to the communication interface 120, wherein the communication interface 120 may be further configured to receive a chemical release command, wherein receipt of the chemical release command causes activation of the one or more chemical actuators.

The portable medication dispenser 100 also includes a Global Positioning System (GPS) locator configured to determine a geographical location of the portable medication dispenser 100. For example, the GPS may be used to determine the location of the portable medication dispenser 100 when tampering is detected or medication is dispensed.

Figure 2A:
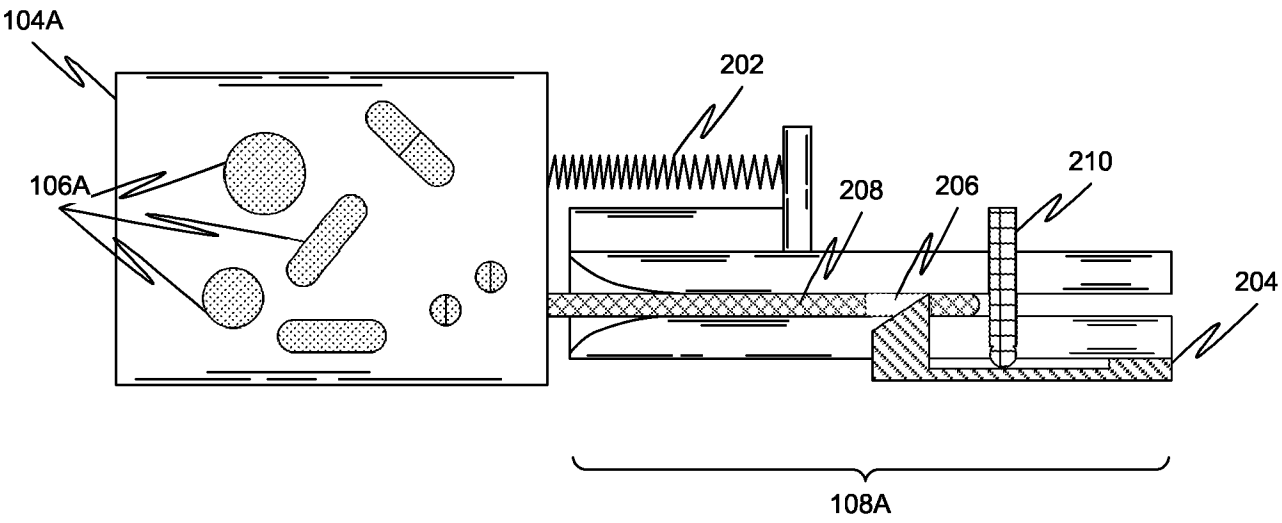
FIGS. 2A-C illustrate a side view cross-section of a compartment corresponding to a latch of a portable medication dispenser in accordance with some embodiments.
Figure 2B:
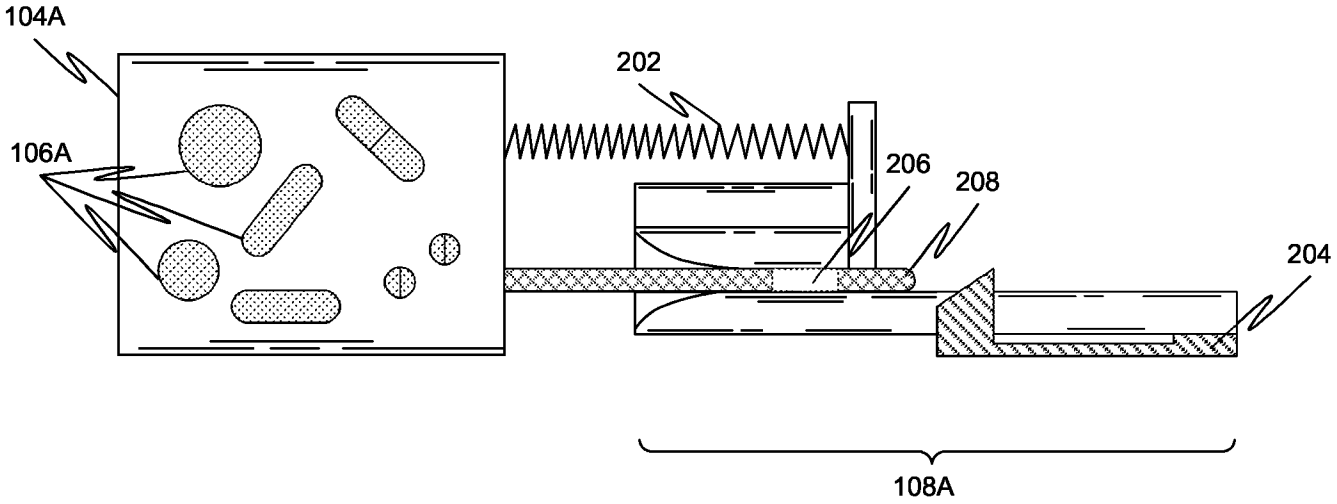
Figure 2C:
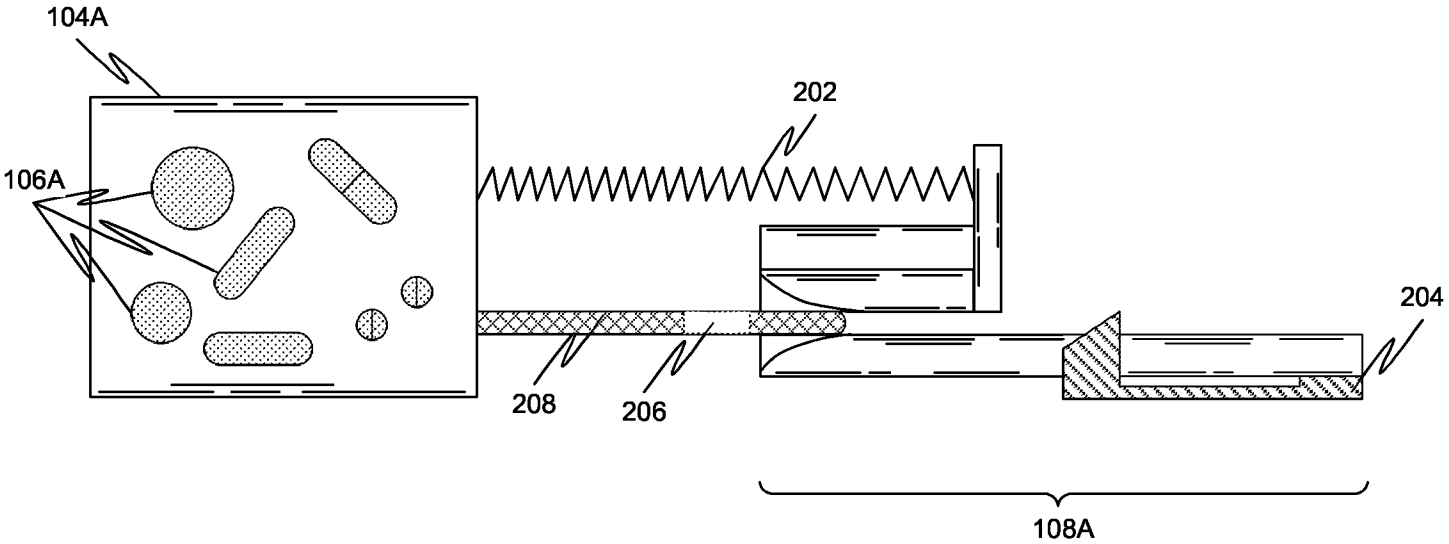

FIGS. 2A-C illustrates a side view cross-section of the compartment 104A corresponding to the latch 108A of the portable medication dispenser 100 in accordance with some embodiments. The compartment 104A corresponding to the latch 108A may be configured as a drawer slidable between a closed position (shown in FIG. 2A) and an open position (shown in FIG. 2B). The drawer may be loaded in the housing 102 via a spring 202. The drawer is filled with the one or more medications 106A by an authorized provider or a pharmacy either manually or using a dedicated automatic filling station. Then, the drawer is pushed into a locked position. The latch 108A may include multiple components such as an internal spring-loaded pin 204 (a flat-spring locking pin) that engages with a hole 206 in a flat plate 208, as shown in FIG. 2A. Therefore, the latch 108A is configured to be in the locked state by the internal spring-loaded pin 204 set in a loaded state, wherein, in the locked state, the drawer is in the closed position. Further, the latch 108A may include a locking pin 210. The locking pin 210 is connected to an actuator in the one or more actuators 110 (not shown). The actuator may push the locking pin 210 downwards to unlock the latch 108A, which releases the drawer, as shown in FIG. 2B.

Moreover, the drawer can be released to a stop point (or a fully released position) for disposal or cleaning, as shown in FIG. 2C.

Further, according to some embodiments, an actuator of the one or more actuators includes a cam mounted on a shaft, wherein the cam is configured to pull back the internal spring-loaded pin 204 into an unloaded state, upon rotation of the shaft, causing the latch 108A to change from the locked state to the unlocked state.

Figure 3:
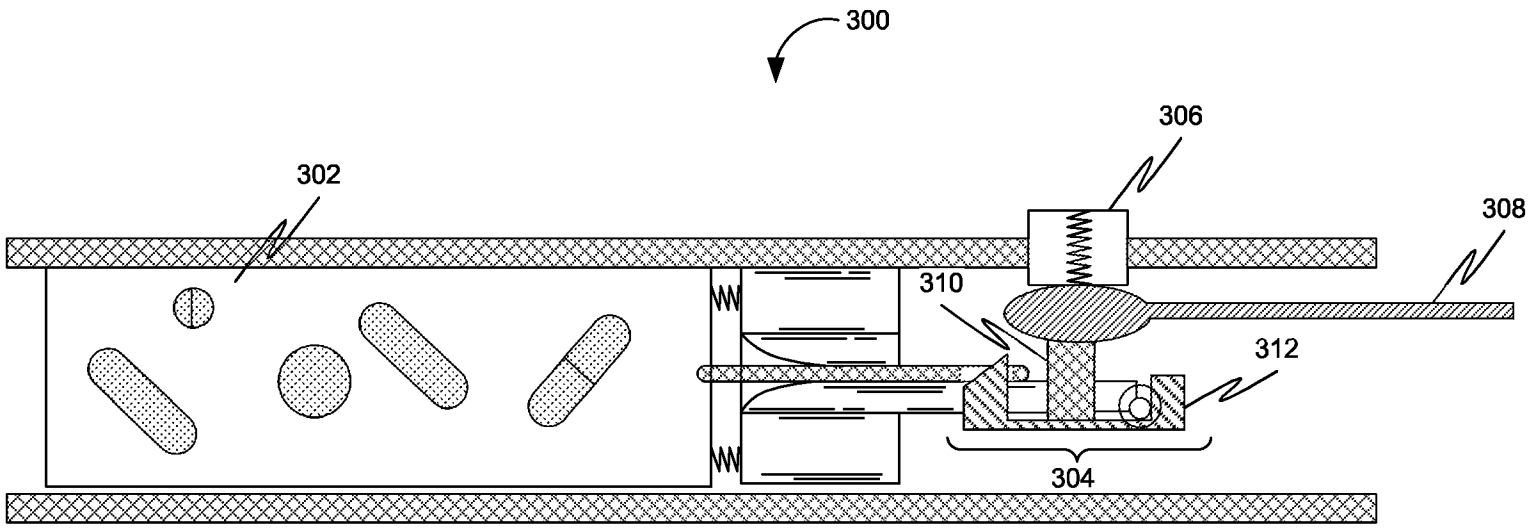
FIG. 3 illustrates a side view cross-section of a compartment corresponding to a latch of a portable medication dispenser in accordance with some embodiments.

FIG. 3 illustrates a side view cross-section of a compartment 302 (similar to the compartment 104A) corresponding to a latch 304 (similar to the latch 108A) of a portable medication dispenser 300 (similar to the portable medication dispenser 100) in accordance with some embodiments. The portable medication dispenser 300 further includes an external manual button 306 corresponding to the latch 304.

The portable medication dispenser 300 further includes an engagement link 308 configured to mechanically couple the manual button 306 with the latch 304. For example, the engagement link 308 may mechanically couple the manual button 306 with a locking pin 310 and an internal spring-loaded pin 312 of the latch 304. The manual button 306 is configured to change a state of the latch 304 from the locked state to the unlocked state based on a pressing of the manual button 306.

Further, the portable medication dispenser 300 includes a button actuator (similar to an actuator in the one or more actuators 110). The button actuator (not shown) is configured to cause the engagement link 308 to couple the manual button 306 with the latch 304. The button actuator is electrically coupled to a controller (similar to the controller 118).

Therefore, the controller may actuate the button actuator to cause the engagement link 308 to couple the manual button 306 with the latch 304. Thereafter, a user of the portable medication dispenser may press the manual button 306 to unlock the compartment 302 to provide access to an interior space of the compartment 302.

Figure 4:
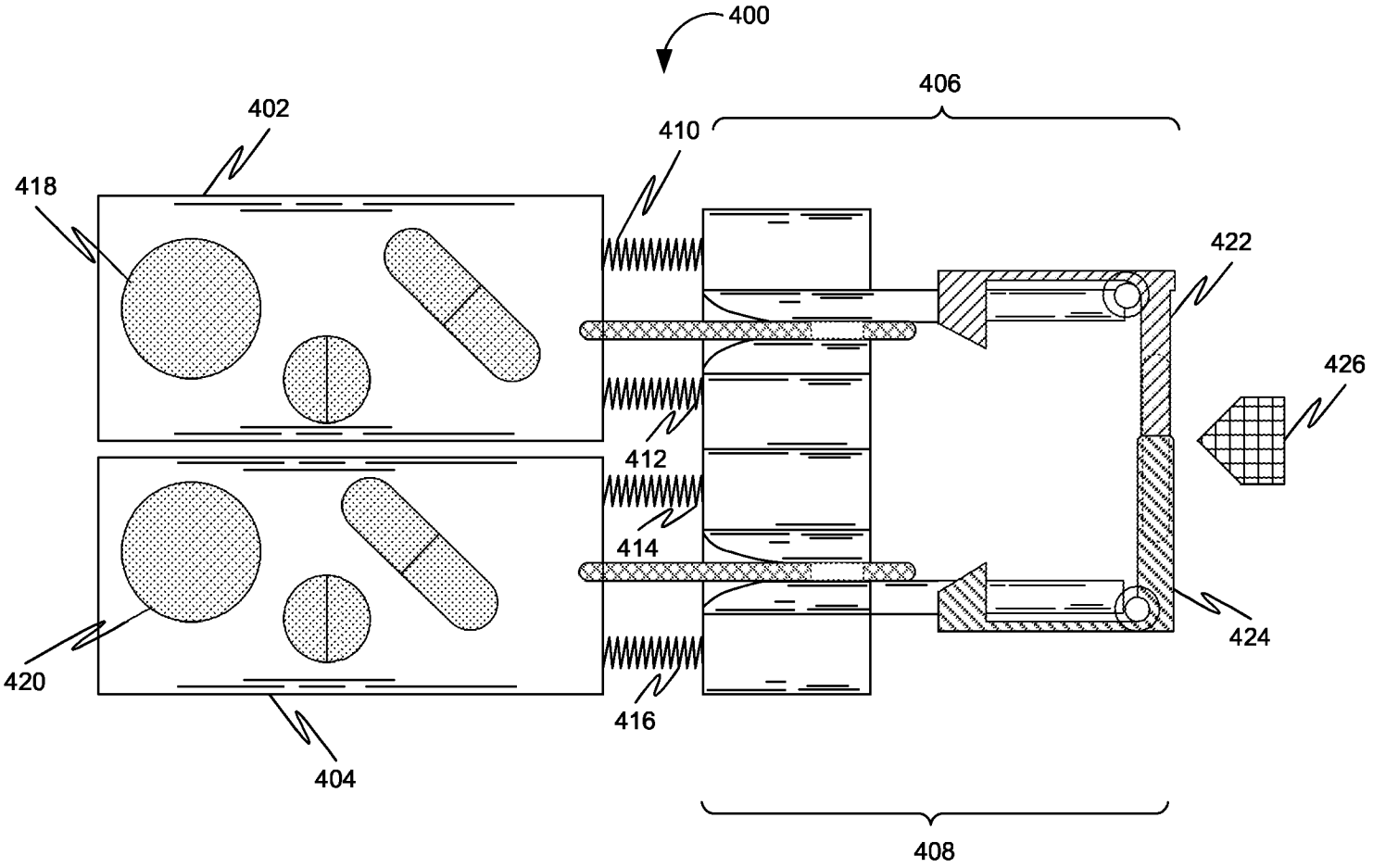
FIG. 4 illustrates a side view cross-section of a portable medication dispenser with stacked compartments in accordance with a further embodiment.

FIG. 4 illustrates a side view cross-section of a portable medication dispenser 400 with stacked compartments 402-404 in accordance with a further embodiment. The compartments 402-404, corresponding to latches 406-408 respectively, may be configured as drawers slidable between an open position and a closed position. The drawer of the compartment 402 may be loaded via springs 410-412. The drawer of the compartment 404 may be loaded via springs 414-416. The drawers are filled with the one or more medications 418-420 by an authorized provider or a pharmacy either manually or using a dedicated automatic filling station. Then, the drawers are pushed into a locked position. The latches 406-408 are shown in the unlocked state in FIG. 4. The latches 406-408 are generally similar to the latch 108A of FIG. 2. The latches 406-408 further include extension arms 422-424, respectively. A locking pin 426 is connected to an actuator (not shown). The actuator may push the locking pin 426 towards the extension arms 422-424. The extension arms 422-424 are placed in a staggered configuration such that the locking pin 426 is able to interact with one of the extension arms 422-424 to unlock the corresponding latch and release the corresponding drawer.

Figure 5A:
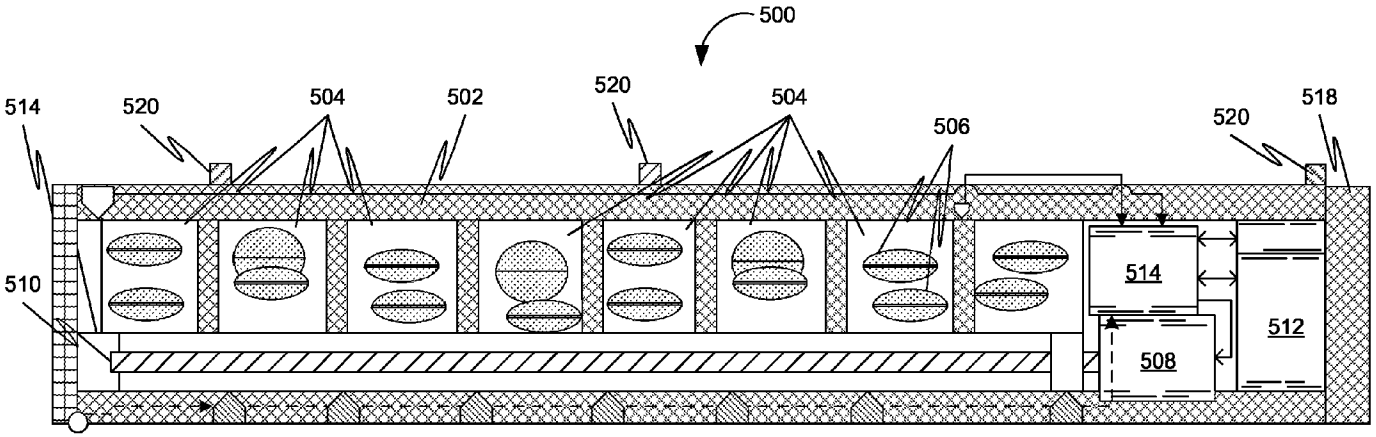
FIGS. 5A-C illustrate a side view cross-section of a portable medication dispenser in accordance with some embodiments.
Figure 5B:
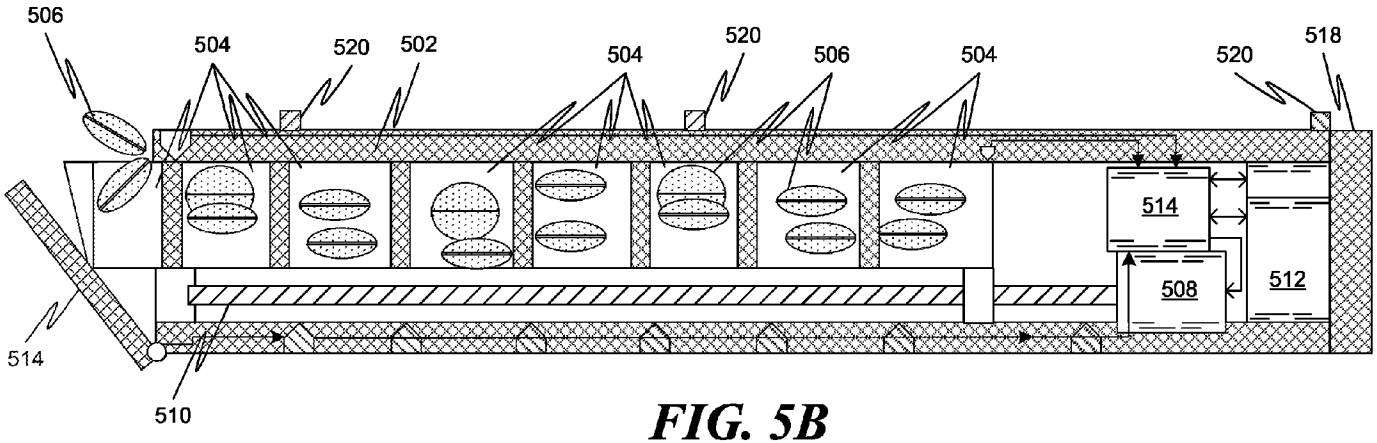
Figure 5C:
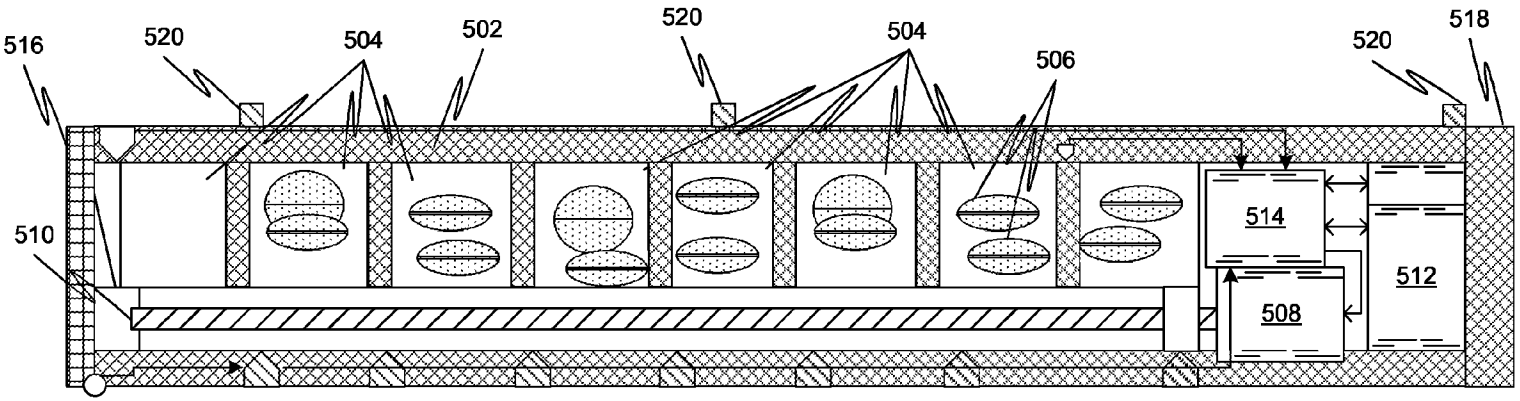
Figure 5D:
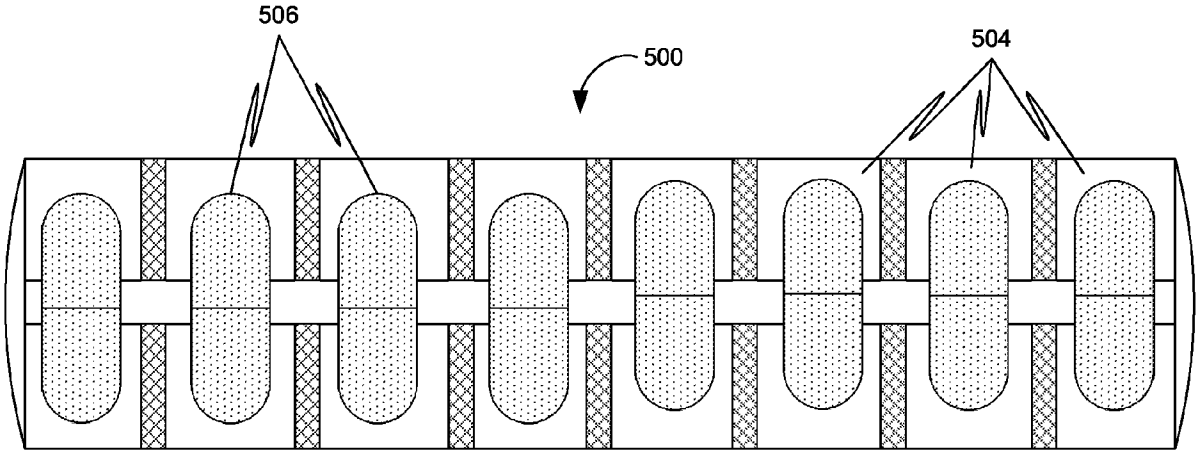
FIG. 5D illustrates a top view cross-section of the portable medication dispenser of FIG. 5A.

FIGS. 5A-C illustrate a side view cross-section of a portable medication dispenser 500 in accordance with some embodiments. FIG. 5D shows a top view cross section of the portable medication dispenser 500. The portable medication dispenser 500 includes a housing 502 comprising multiple compartments 504. For example, the housing 502 may include eight compartments in a single row. Each compartment in the multiple compartments 504 is configured to accommodate one or more medications 506. The portable medication dispenser 500 can be either hardened to prevent medication abuse or unhardened for patients with low abuse risk.

The multiple compartments 504 may be configured as a single drawer slidable between a closed position (shown in FIGS. 5A and 5C) and an open position (shown in FIG. 5B).

Further, the portable medication dispenser 500 includes one or more actuators including a stepper motor 508 with a screw drive 510. The screw drive 510 is mechanically coupled with the drawer, such that when the screw drive 510 is actuated, the drawer also moves along with it.

Further, the portable medication dispenser 500 includes a battery 512 configured to supply power to drive the one or more actuators. Yet further, the portable medication dispenser 100 includes a controller 514 electrically coupled to the one or more actuators. The controller 514 is configured to activate the one or more actuators.

Moreover, the portable medication dispenser 500 includes a latch 516. The latch 516 is configured to be in the locked state in a loaded state, wherein, in the locked state, the housing 102 is in the closed position (as show in FIG. 5A). The controller 514 may activate the stepper motor 508 which then actuates the screw drive 510 to move the drawer out of the housing 102, as shown in FIG. 5B. The controller 514 tracks the location of the multiple compartments 504. Further, the controller 514 has the information about the fixed distances in terms of stepper-motor pulses. Therefore, the controller 514 extends the drawer only out far enough to allow access to the medication in one compartment at a time. If a patient tries to pull the drawer out further, the corresponding compartment breaks off along a pre-scored line on compartment boundaries. The remaining compartmented segments will remain intact.

Once a patient has withdrawn mediation from an open compartment, the drawer returns to full-safe position at patient request or by an automatic process, as shown in FIG. 5C. At the next appropriate time request, the drawer will slide out far enough for the patient to access the next medication in the prescribed sequence. Further, an audio or vibrating alert may be sent to remind the patient at the exact time the dosage should be administered.

Further, the portable medication dispenser 500 includes a communication interface 518 coupled to the controller 514. The communication interface 518 is configured to receive one or more commands associated with activating the one or more actuators. The communication interface 518 may be used for attaching additional control circuitry, additional interface features or communication devices such as smartphones or location tracking units.

Moreover, the portable medication dispenser 500 includes connection points 520 on the top face of the portable medication dispenser 500. The connection points 520 may be used for attaching additional control circuitry, additional interface features or communication devices such as smartphones or location tracking units.

Figure 6:
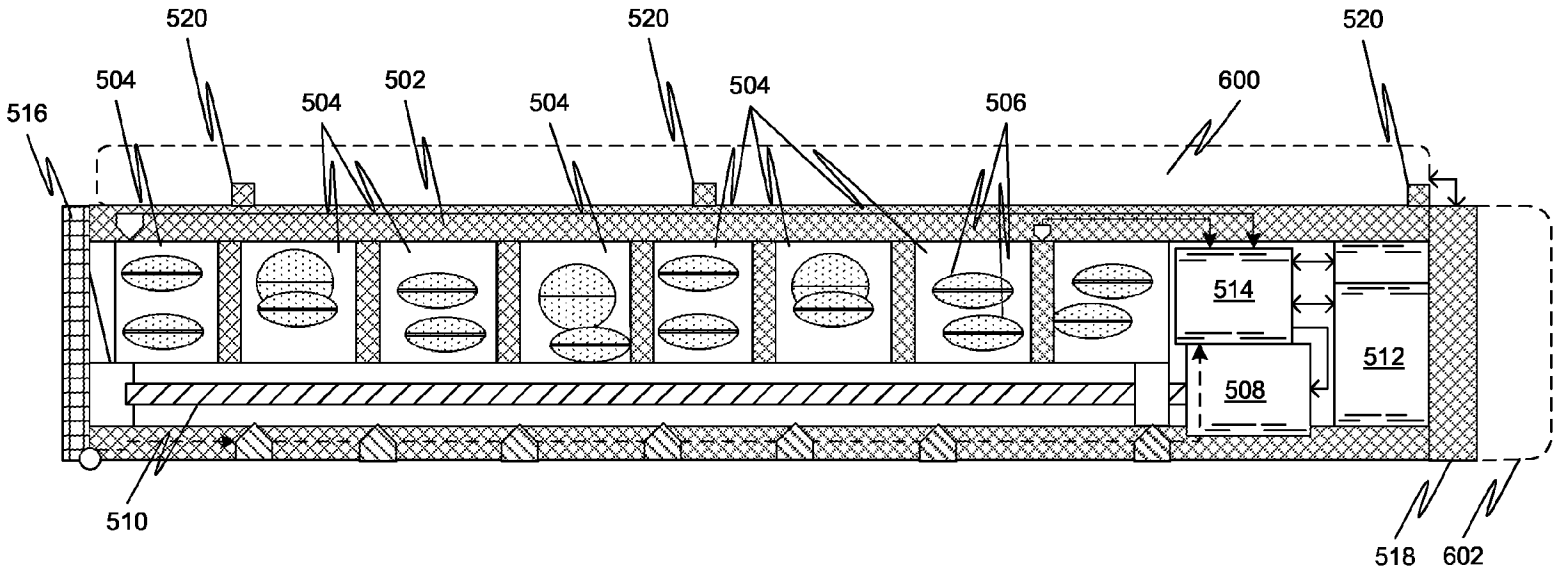
FIG. 6 illustrates a side view cross-section of a portable medication dispenser connected to a smartphone in accordance with some embodiments.

FIG. 6 shows a side view cross-section of the portable medication dispenser 500 connected to a smartphone 600 via one or more of the communication interface 518 and the connection points 520. The smartphone 600 may latch onto the portable medication dispenser 500 via one or more latch features (not shown). A user may control operation of the portable medication dispenser 500 through a touchscreen of the smartphone 600. Further, a GPS module 602 (for wireless tracking) may be attached to the communication interface 518.

Figure 7:
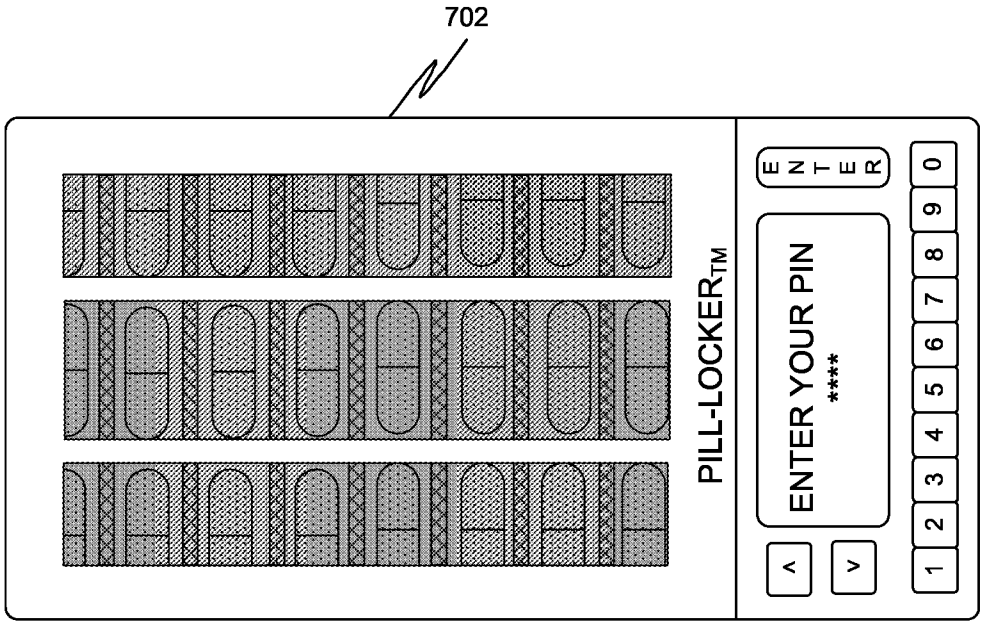
FIG. 7 illustrates a top view of a portable medication dispenser connected to an electronics control unit in accordance with some embodiments.

Alternatively, an electronic control unit 702 may be connected to the portable medication dispenser 500 via one or more of the communication interface 518 and the connection points 520, as shown in FIG. 7. Further, the portable medication dispenser 500 may be permanently attached with the electronic control unit 702.

One or both of the smartphone 600 and the electronic control unit 702 may allow a patient to put in a PIN to unlock the portable medication dispenser 500. The PIN may be pre-determined PN such that the patient may be allowed to feed in the PIN based on the prescribed medical regimen. Alternatively, a new PIN may be sent to the patient each time medication is to be taken according to the prescribed medical regimen. For example, the PIN may be sent to the patient via an SMS, a smartphone application notification, an MMS, a phone call and an email.

Exemplary Embodiments

A portable medication dispenser may include a housing including a plurality of compartments. Further, each compartment may be configured to accommodate at least one medication. Further, the housing may be constructed with a tamper-proof material. Further, the portable medication dispenser may include a plurality of latches corresponding to the plurality of compartments. Further, a latch corresponding to a compartment may be configured to be in one of a locked state and an unlocked state. Further, in the locked state, the latch may be configured to prevent access to an interior space of the compartment. Further, in the unlocked state, the latch may be configured to allow access to the interior space facilitating dispensing of the at least one medication. Further, the portable medication dispenser may include at least one actuator configured to engage with at least one latch of the plurality of latches. Further, when activated, the at least one actuator engaged with a latch may be configured to change the state of the latch from the locked state to the unlocked state. Further, the portable medication dispenser may include at least one power source configured to supply power to drive the at least one actuator. Further, the portable medication dispenser may include a controller electrically coupled to the at least one actuator. Further, the controller may be configured to activate the at least one actuator. Further, the portable medication dispenser may include a communication interface coupled to the controller. Further, the communication interface may be configured to receive at least one command associated with activating the at least one actuator.

In some embodiments, the latch may include a sliding door and an internal spring-loaded pin. Further, the sliding door may be configured to be in the locked state by the internal spring-loaded pin set in a loaded state. Further, an actuator of the at least one actuator may include a solenoid configured to pull back the internal spring-loaded pin into an unloaded state, causing the latch to change from the locked state to the unlocked state. Further, in the unlocked state, the sliding door creates an opening into the interior space of the compartment.

In some embodiments, the at least one actuator may include a motor driven slide. Further, the solenoid may be slidably mounted on the motor driven slide. Further, activating the at least one actuator may include driving the motor driven slide to displace the solenoid to a position on the motor driven slide corresponding to the compartment.

In some embodiments, the at least one actuator may include a plurality of solenoids corresponding to the plurality of compartments.

In some embodiments, the housing may be shaped as a disc. Further, the plurality of compartments may be arranged around the disc. Further, the solenoid may be disposed at a central region of the disc.

In some embodiments, the latch may include a sliding door and an internal spring-loaded pin. Further, the sliding door may be configured to be in the locked state by the internal spring-loaded pin set in a loaded state. Further, an actuator of the at least one actuator may include a cam mounted on a shaft. Further, the cam may be configured to pull back the internal spring-loaded pin into an unloaded state, upon rotation of the shaft, causing the latch to change from the locked state to the unlocked state. Further, in the unlocked state, the sliding door creates an opening into the interior space of the compartment.

In some embodiments, the at least one actuator may include a micro-hydraulic piston including an electrically controlled micro valve configured for directing a fluid.

In some embodiments, the at least one actuator may include a pneumatic piston including an electrically controlled micro valve configured for directing a pressurized gas.

In some embodiments, the at least one actuator may include a stepper motor.

In some embodiments, the compartment corresponding to the latch may be configured as a drawer slidable between an open position and a closed position. Further, the latch may include an internal spring-loaded pin. Further, the latch may be configured to be in the locked state by the internal spring-loaded pin set in a loaded state. Further, in the locked state, the drawer may be in the closed position. Further, an actuator of the at least one actuator may be configured to release the internal spring-loaded pin into an unloaded state causing the latch to change from the locked state to the unlocked state. Further, in the unlocked state, the drawer may be slidable to the open position.

In some embodiments, the communication interface may be configured to wirelessly receive the at least one command.

In some embodiments, the portable medication dispenser may further include a memory communicatively coupled to the controller. Further, the memory may be configured to store the at least one command.

In some embodiments, the communication interface may be further configured to transmit data associated with activating the at least one actuator. Further, the data may be stored in the memory.

In some embodiments, the communication interface may be further configured to transmit data associated with at least one state of the at least one actuator. Further, the data may be stored in the memory. Further, the portable medication dispenser may include at least one sensor configured to detect the at least one state.

In some embodiments, the portable medication dispenser may further include at least one light indicator configured to indicate the at least one state.

In some embodiments, the memory may be configured to store at least one dispensing schedule. Further, the controller may be further configured to activate the at least one actuator based on the dispensing schedule.

In some embodiments, the portable medication dispenser may further include a vibrator configured to generate one or more of an audible sound and a vibration. Further, the vibrator may be communicatively coupled to the controller and the at least one power source. Further, the controller may be further configured to activate the vibrator based on the dispensing schedule.

In some embodiments, the portable medication dispenser may further include a tampering sensor configured to detect tampering performed on the portable medication dispenser.

In some embodiments, the tampering sensor may be communicatively coupled to the communication interface. Further, the communication interface may be further configured to transmit a tampering alert based on detection of tampering.

In some embodiments, the portable medication dispenser may further include: at least one chemical container including a chemical agent; and at least one chemical actuator configured to release the chemical agent into at least one compartment of the plurality of compartments when the chemical actuator may be activated. Further, the at least one chemical actuator may be communicatively coupled to the tampering sensor. Further, detection of the tampering causes activation of the at least one chemical actuator.

In some embodiments, the chemical agent may be configured to react with a medication contained in the at least one compartment in order to render the medication unusable.

In some embodiments, the tampering sensor may be configured to detect a breaking of the plurality of compartments.

In some embodiments, the portable medication dispenser may further include: at least one chemical container including a chemical agent; and at least one chemical actuator configured to release the chemical agent into at least one compartment of the plurality of compartments when the chemical actuator may be activated. Further, the at least one chemical actuator may be communicatively coupled to the communication interface. Further, the communication interface may be further configured to receive a chemical release command. Further, receipt of the chemical release command causes activation of the at least one chemical actuator.

In some embodiments, the portable medication dispenser may further include a Global Positioning System (GPS) locator configured to determine a geographical location of the portable medication dispenser.

In some embodiments, the communication interface may be configured to mount a smartphone. Further, mounting of the smartphone enables communication between the portable medication dispenser and the smartphone.

In some embodiments, mounting of the smartphone enables a user to control operation of the portable medication dispenser through a touchscreen of the smartphone.

In some embodiments, the tamper-proof material may be one or more of stainless steel, a metal alloy, a high strength acrylic laminate and a composite plastic.

In some embodiments, an exposed surface of the plurality of compartments may be configured to be convex in shape in order to thwart tampering.

In some embodiments, an exposed surface of the plurality of compartments may be coated with an abrasive or vitreous material configured to abrade or deflect a drill-bit.

In some embodiments, the portable medication dispenser may further include: a plurality of external manual buttons corresponding to the plurality of latches; an engagement link configured to mechanically couple the plurality of external manual buttons with the plurality of latches. Further, a manual button may be configured to change a state of a latch from the locked state to the unlocked state based on a pressing of the manual button. Further, manual button may be capable of changing the state of the latch when the engagement link couples the manual button to the latch; and a button actuator mechanically coupled to the engagement link. Further, the button actuator may be configured to cause the engagement link to couple the plurality of buttons with the plurality of latches.

According to some embodiments, a portable tamper-proof remote controlled & automated prescription pill and capsule dispenser is disclosed. The pill and capsule dispenser includes a storage module and a controller module. The storage module (or the dispenser module) may contains 32 individual compartments to hold each individual, periodic dose of pills and capsules for a defined treatment period. There may be four rows of eight compartments per row, two opposing rows aligned on each side of the module (smaller and larger sized storage modules will also be available and will be interchangeable with the same controller module). Each compartment has a free-sliding door that is locked by an internal spring-loaded pin. An internal sliding mechanism with four pull-type micro-solenoids traveling on either a manual or motor-driven slide will pass sensors and contact points located next to each compartment and be activated by the controller unit. LEDs will indicate which compartment is active to open. One of the four micro-solenoids of the unit will pull back the spring-loaded pin and the sliding door will be free to open and allow the dispensing of the medication. The compartments are filled with pills and capsules by an authorized provider or a pharmacy either manually or using a dedicated automatic filling station. The empty module can be immersed for cleaning. An embedded "hard point" fitting on the module will allow user to secure the device to an immobile structure if desired.

Further, the controller module includes electronic components to manage the dispensing of medications by moving and actuating the four micro-solenoids in the dispenser module. This is triggered in accordance to commands entered through any number of I/O ports or through wireless transmissions and stored in the controller module memory. The controller module also tracks medication use over time and can interface with various communication networks. It can allow authorized patients to dispense more than a single day's dosage if patient needs to travel without the dispenser for short periods. The controller module allows for the attachment optional consumer cell phones and smart phones as well as the addition specialized location transmission tracking and tamper alert devices.

In further embodiments, a smaller, disk-shaped unit is employed for dispensing less than four pills per cell that will employ a disk or lozenge shaped device with a single central solenoid or step-motor that will be rotated into position, either manually or by motor, to unlock one of a number small cells when provided current through electronically programmed routine.

In further embodiments, the four moving solenoids are substituted with a mechanical linkage with slider, cams and levers and or worm gear to open pill doors, and powered either manually or by motor.

In further embodiments, the four moving solenoids are substituted with micro hydraulic pistons to open pill doors with hydraulic pressure provided manually by user and electronic controlled micro valves directing the fluids.

In further embodiments, the four moving solenoids are substituted with pneumatic pistons to open pill doors with air or gas pressure provided manually by user and electronic controlled micro valves directing the pressurized air or pressurized gas.

In further embodiments, small standard or stepper motors and servos with controllers are used to operate cams and screw drive mechanisms that actuate sliding or spring loaded removable drawers, hatches or doors to allow access to single or multiple doses of medication.

In further embodiments, screw drive mechanisms and standard, stepper and servo motors along with controllers and sensors are used to extend sliding, removable compartmented drawers a predefined distance to allow for the dispensing of a series of medications that must be administered in precise sequence and/or at multiple and specific times of the day. The controller and sensor track the position of the pill by sensing the position of the individual compartments within the drawer and actuating the motor or servo to extend the drawer out only far enough to allow access to the current dose. At the next prescribed time frame, the drawer will, when actuated by patient, slide out far enough for the patient to access the next medication in the prescribed sequence. An audio or vibrating alert can be sent to remind the patient at the exact time the dosage should be administered. Any attempt to force the drawer out further in order to access additional medication will result in that portion of the empty compartment to break off along a pre-scored line and the compartmented segments will remain intact and inaccessible. Breaking the compartment will then trigger the alert transmission to the cellular service.

According to some embodiments, a portable tamperproof remote controlled and automated prescription pill and capsule dispenser is disclosed. The pill and capsule dispense includes one or more of a dispenser case, at least one pill compartment, a tray-extension mechanism, a microcontroller, a user-interface, wherein the at least one pill compartment laterally and slidably engaging the dispenser case, wherein the tray-extension mechanism mounted within the dispenser case, wherein the at least one pill compartment being extendably mounted to the tray-extension mechanism, wherein the tray-extension mechanism being electronically connected to the microcontroller, wherein the user-interface being externally integrated with the dispenser case and the user-interface being electronically connected to the microcontroller.

Further, in some embodiments, the tray-extension mechanism comprises a tray-position controller and a tray-position actuator, wherein the at least one pill compartment being a plurality of pill compartments, wherein the plurality of pill compartments being adjacently and serially connected to each other and a terminal pill compartment of the plurality of pill compartments being mounted to the tray position actuator. In some embodiments, the tray-position actuator is a worm-drive.

Further, in some embodiments, the tray-extension mechanism comprises at least one spring, at least one compartment latch, at least one compartment catch, and at least one latch actuator. Further, the portable tamperproof remote controlled and automated prescription pill and capsule dispenser includes the at least one spring being adjacently and internally connected to the dispenser case, wherein the at least one spring being positioned between the dispenser case and a corresponding pill compartment of the at least one pill compartment, wherein the at least one compartment latch being mounted to the corresponding pill compartment, wherein the at least one compartment latch being internally and pivotably mounted within the dispenser case and the at least one latch actuator operatively coupled with the at least one compartment latch.

In some embodiments, the portable tamperproof remote controlled and automated prescription pill and capsule dispenser includes the at least one compartment latch selectively engaging the at least one compartment catch.

Further, in some embodiments, the portable tamperproof remote controlled and automated prescription pill and capsule dispenser includes the at least one latch actuator being a push button actuator, wherein the push button actuator traversing into the dispenser case and the push button actuator being adjacently connected to the at least one compartment latch.

Further, in some embodiments, the at least one latch actuator is a pneumatic actuator, wherein the pneumatic actuator being internally mounted to the dispenser case and the pneumatic actuator being pressed against the at least one compartment latch.

Yet further, in some embodiments, the user-interface comprises a display screen and a plurality of input buttons, wherein the display screen being integrated with the dispenser case, wherein the plurality of input buttons being integrated with the dispenser case, wherein the plurality of input buttons being adjacently positioned to the display screen, and the display screen and the plurality of input buttons being electronically connected with the microcontroller.

In some embodiments, the portable tamperproof remote controlled and automated prescription pill and capsule dispenser includes a wireless transceiver, wherein the wireless transceiver being internally mounted to the dispenser case, and the wireless transceiver being electronically connected to the microcontroller.

Yet further, in some embodiments, the portable tamperproof remote controlled and automated prescription pill and capsule dispenser includes one or more of the at least one data transmission bus, wherein the at least one data transmission bus being externally integrated to the dispenser case, and the at least one data transmission bus being electronically connected to the microcontroller.

Further, in some embodiments, the portable tamperproof remote controlled and automated prescription pill and capsule dispenser includes one or more of the battery, wherein the battery being internally connected with the dispenser case and the battery being electronically connected to the microcontroller.

Moreover, in some embodiments, the portable tamperproof remote controlled and automated prescription pill and capsule dispenser includes a global positioning system (GPS) device, wherein the GPS device being internally mounted within the dispenser case and the GPS device being electronically connected to the microcontroller.

In some embodiments, the portable tamperproof remote controlled and automated prescription pill and capsule dispenser includes an actuatable door, wherein the actuatable door being laterally mounted onto the dispenser case, wherein the actuatable door being positioned adjacent to the at least one pill compartment, wherein the actuatable door being electronically connected to the microcontroller.

Although the invention has been explained in relation to its preferred embodiment, it is understood that many other possible modifications and variations can be made without departing from the spirit and scope of the invention as herein described.

I claim:

1. A portable medication dispenser comprising:

a housing comprising a plurality of compartments, wherein each compartment is configured to accommodate at least one medication, wherein the housing is constructed with a tamper-proof material;

a plurality of latches corresponding to the plurality of compartments, wherein a latch corresponding to a compartment is configured to be in one of a locked state and an unlocked state, wherein, in the locked state, the latch is configured to prevent access to an interior space of the compartment, wherein, in the unlocked state, the latch is configured to allow access to the interior space facilitating dispensing of the at least one medication;

at least one actuator configured to engage with at least one latch of the plurality of latches, wherein, when activated, the at least one actuator engaged with a latch is configured to change the state of the latch from the locked state to the unlocked state;

at least one power source configured to supply power to drive the at least one actuator;

a controller electrically coupled to the at least one actuator, wherein the controller is configured to activate the at least one actuator;

a communication interface coupled to the controller, wherein the communication interface is configured to receive at least one command associated with activating the at least one actuator;

the housing being shaped as a disc;

the plurality of compartments being arranged around the disc;

a solenoid; and the solenoid being disposed at a central region of the disc.

2. The portable medication dispenser of claim 1, wherein the latch comprises a sliding door and an internal spring-loaded pin, wherein the sliding door is configured to be in the locked state by the internal spring-loaded pin set in a loaded state, wherein an actuator of the at least one actuator comprises the solenoid configured to pull back the internal spring-loaded pin into an unloaded state, causing the latch to change from the locked state to the unlocked state, wherein, in the unlocked state, the sliding door creates an opening into the interior space of the compartment.

3. The portable medication dispenser of claim 2, wherein the at least one actuator comprises a motor driven slide, wherein the solenoid is slidably mounted on the motor driven slide, wherein activating the at least one actuator comprises driving the motor driven slide to displace the solenoid to a position on the motor driven slide corresponding to the compartment.

4. The portable medication dispenser of claim 2, wherein the at least one actuator comprises a plurality of solenoids corresponding to the plurality of compartments.

5. The portable medication dispenser of claim 1, wherein the latch comprises a sliding door and an internal spring-loaded pin, wherein the sliding door is configured to be in the locked state by the internal spring-loaded pin set in a loaded state, wherein an actuator of the at least one actuator comprises a cam mounted on a shaft, wherein the cam is configured to pull back the internal spring-loaded pin into an unloaded state, upon rotation of the shaft, causing the latch to change from the locked state to the unlocked state, wherein, in the unlocked state, the sliding door creates an opening into the interior space of the compartment.

6. The portable medication dispenser of claim 1, wherein the at least one actuator comprises a micro-hydraulic piston comprising an electrically controlled micro valve configured for directing a fluid.

7. The portable medication dispenser of claim 1, wherein the at least one actuator comprises a pneumatic piston comprising an electrically controlled micro valve configured for directing a pressurized gas.

8. The portable medication dispenser of claim 1, wherein the at least one actuator comprises a stepper motor.

9. The portable medication dispenser of claim 1, wherein the compartment corresponding to the latch is configured as a drawer slidable between an open position and a closed position, wherein the latch comprises an internal spring-loaded pin, wherein the latch is configured to be in the locked state by the internal spring-loaded pin set in a loaded state, wherein, in the locked state, the drawer is in the closed position, wherein an actuator of the at least one actuator is configured to release the internal spring-loaded pin into an unloaded state causing the latch to change from the locked state to the unlocked state, wherein, in the unlocked state, the drawer is slidable to the open position.

10. The portable medication dispenser of claim 1, wherein the communication interface is configured to wirelessly receive the at least one command.

11. The portable medication dispenser of claim 1 further comprising a memory communicatively coupled to the controller, wherein the memory is configured to store the at least one command.

12. The portable medication dispenser of claim 11, wherein the communication interface is further configured to transmit data associated with activating the at least one actuator, wherein the data is stored in the memory.

13. The portable medication dispenser of claim 1, wherein the communication interface is further configured to transmit data associated with at least one state of the at least one actuator, wherein the data is stored in the memory, wherein the portable medication dispenser comprises at least one sensor configured to detect the at least one state.

14. The portable medication dispenser of claim 13 further comprising at least one light indicator configured to indicate the at least one state.

15. The portable medication dispenser of claim 11, wherein the memory is configured to store at least one dispensing schedule, wherein the controller is further configured to activate the at least one actuator based on the dispensing schedule.

16. The portable medication dispenser of claim 15 further comprising a vibrator configured to generate at least one of an audible sound and a vibration, wherein the vibrator is communicatively coupled to the controller and the at least one power source, wherein the controller is further configured to activate the vibrator based on the dispensing schedule.

17. The portable medication dispenser of claim 1 further comprising a tampering sensor configured to detect tampering performed on the portable medication dispenser.

18. The portable medication dispenser of claim 17, wherein the tampering sensor is communicatively coupled to the communication interface, wherein the communication interface is further configured to transmit a tampering alert based on detection of tampering.

19. The portable medication dispenser of claim 18 further comprising:

at least one chemical container comprising a chemical agent; and at least one chemical actuator configured to release the chemical agent into at least one compartment of the plurality of compartments when the chemical actuator is activated, wherein the at least one chemical actuator is communicatively coupled to the tampering sensor, wherein detection of the tampering causes activation of the at least one chemical actuator.

20. The portable medication dispenser of claim 19, wherein the chemical agent is configured to react with a medication contained in the at least one compartment in order to render the medication unusable.

21. The portable medication dispenser of claim 20, wherein the tampering sensor is configured to detect a breaking of the plurality of compartments.

22. The portable medication dispenser of claim 1 further comprising:

at least one chemical container comprising a chemical agent; and at least one chemical actuator configured to release the chemical agent into at least one compartment of the plurality of compartments when the chemical actuator is activated, wherein the at least one chemical actuator is communicatively coupled to the communication interface, wherein the communication interface is further configured to receive a chemical release command, wherein receipt of the chemical release command causes activation of the at least one chemical actuator.

23. The portable medication dispenser of claim 1 further comprising a Global Positioning System (GPS) locator configured to determine a geographical location of the portable medication dispenser.

24. The portable medication dispenser of claim 1, wherein the communication interface is configured to mount a smartphone, wherein mounting of the smartphone enables communication between the portable medication dispenser and the smartphone.

25. The portable medication dispenser of claim 24, wherein mounting of the smartphone enables a user to control operation of the portable medication dispenser through a touchscreen of the smartphone.

26. The portable medication dispenser of claim 1, wherein the tamper-proof material is at least one of stainless steel, a metal alloy, a high strength acrylic laminate and a composite plastic.

27. The portable medication dispenser of claim 1, wherein an exposed surface of the plurality of compartments is configured to be convex in shape in order to thwart tampering.

28. The portable medication dispenser of claim 1, wherein an exposed surface of the plurality of compartments is coated with at least one of an abrasive and a vitreous material configured to perform at least one of abrade and deflect a drill-bit.

29. The portable medication dispenser of claim 1 further comprising:

a plurality of external manual buttons corresponding to the plurality of latches;

an engagement link configured to mechanically couple the plurality of external manual buttons with the plurality of latches, wherein a manual button is configured to change a state of a latch from the locked state to the unlocked state based on a pressing of the manual button, wherein manual button is capable of changing the state of the latch when the engagement link couples the manual button to the latch; and a button actuator mechanically coupled to the engagement link, wherein the button actuator is configured to cause the engagement link to couple the plurality of buttons with the plurality of latches.

* * * * *